US010888172B2

(12) United States Patent
Xia et al.

(10) Patent No.: US 10,888,172 B2
(45) Date of Patent: Jan. 12, 2021

(54) FOLDING BED

(71) Applicant: Zhejiang Natural Outdoor Goods Inc., Taizhou (CN)

(72) Inventors: Yonghui Xia, Taizhou (CN); Jinglong Cao, Taizhou (CN); Zhijian Ma, Taizhou (CN); Hanxiao Yu, Taizhou (CN); Jingwen Qiu, Taizhou (CN); Mengxiao Cao, Taizhou (CN)

(73) Assignee: Zhejiang Natural Outdoor Goods Inc.

( * ) Notice: Subject to any disclaimer, the term of this patent is extended or adjusted under 35 U.S.C. 154(b) by 513 days.

(21) Appl. No.: 15/627,794

(22) Filed: Jun. 20, 2017

(65) Prior Publication Data

US 2018/0070735 A1 Mar. 15, 2018

(30) Foreign Application Priority Data

Sep. 9, 2016 (CN) ..... 2016 1 0813198
May 31, 2017 (CN) ..... 2017 1 0398927

(51) Int. Cl.
*A47C 27/08* (2006.01)
*A47C 19/12* (2006.01)
*A47C 17/70* (2006.01)

(52) U.S. Cl.
CPC ..... *A47C 27/081* (2013.01); *A47C 17/70* (2013.01); *A47C 19/122* (2013.01)

(58) Field of Classification Search
CPC ..... A47C 27/081; A47C 17/70; A47C 17/74; A47C 19/122
See application file for complete search history.

(56) References Cited

U.S. PATENT DOCUMENTS 3,045,257 A * 7/1962 Knapp ..... A47C 27/081 5/111
3,967,330 A * 7/1976 Zawadowsky ..... A47C 19/122 5/114
4,012,800 A * 3/1977 Mitchell ..... A23B 7/148 5/187
4,594,743 A * 6/1986 Owen ..... A47C 17/70 5/111

(Continued)

FOREIGN PATENT DOCUMENTS

CH 263612 A * 9/1949 ..... A47C 17/70
CN 2 115 705 U 9/1992

(Continued)

OTHER PUBLICATIONS

Extended European Search Report for Application No. EP 17 184 247.9 dated Dec. 21, 2017 (8 pages).

(Continued)

*Primary Examiner* — David R Hare
*Assistant Examiner* — Alexis Felix Lopez
(74) *Attorney, Agent, or Firm* — Harness, Dickey & Pierce, P.L.C.

(57) ABSTRACT

A folding bed is provided, comprising: a support frame and an air mattress; the air mattress is arranged on the support frame; the support frame is used to support the air mattress. When a user lies on the air mattress, the air mattress touches the back of the human body. Since the air mattress is internally filled with air, the air mattress is relatively soft when supporting the back of the human body, thus the comfort degree of the folding bed is improved.

18 Claims, 9 Drawing Sheets

(56) References Cited

U.S. PATENT DOCUMENTS

| | | | | | |
|---|---|---|---|---|---|
| 5,598,593 | A * | 2/1997 | Wolfe | A47C 27/081 5/710 |
| D407,575 | S * | 4/1999 | Meoli, Jr. | D6/392 |
| 8,806,675 | B2 * | 8/2014 | Lah | A47C 19/12 5/111 |
| 9,848,710 | B2 * | 12/2017 | Choi | A47C 19/126 |
| 2007/0095990 | A1 * | 5/2007 | Park | A47C 17/70 248/200 |
| 2014/0115780 | A1 | 5/2014 | Lah | |

FOREIGN PATENT DOCUMENTS

| | | | | | |
|---|---|---|---|---|---|
| CN | 2 295 395 | Y | | 10/1998 | |
| CN | 2 446 880 | Y | | 9/2001 | |
| CN | 201 219 708 | Y | | 4/2009 | |
| CN | 202 874 606 | U | | 4/2013 | |
| CN | 203 969 837 | U | | 12/2014 | |
| CN | 204 683 098 | U | | 10/2015 | |
| CN | 205 125 648 | U | | 4/2016 | |
| DE | 2 027 671 | A1 | | 4/1972 | |
| FR | 750628 | A | * | 8/1933 | A47C 17/70 |
| GB | 2 239 592 | A | | 7/1991 | |

OTHER PUBLICATIONS

First Office Action for Chinese Application No. 2016-10813198.4 dated Feb. 7, 2018 with English translation (16 pages).
Second Office Action for Chinese Application No. 2016-10813198.4 dated Sep. 10, 2018 with English translation (13 pages).

* cited by examiner

FOLDING BED

CROSS REFERENCE TO RELATED APPLICATIONS

The present application claims the priority of Chinese patent application No. CN201610813198.4, filed on Sep. 9, 2016 with the State Intellectual Property Office, entitled "Multifunctional Camp Bed", and the priority of Chinese patent application No. CN201710398927.9, filed on May 31, 2017 with the State Intellectual Property Office, entitled "Camp Bed Frame and Camp Bed", which are incorporated herein by reference in their entirety.

TECHNICAL FIELD

The present invention relates to the technical field of bedding, and particularly to a folding bed.

BACKGROUND ART

A folding bed is usually made by tying canvas to a wood frame or a metal frame, mostly for marching or field work. It has a small volume after being folded into a bag, and has the characteristics of being easy to carry.

The folding beds in the prior art include a bed frame and a bed cloth. When needed, the user unfolds the bed frame, and then ties the bed cloth to the bed frame, and the human body lies on the bed cloth.

However, when using the folding beds in the prior art, the comfort degree of the folding bed when the human body lies thereon is relatively low.

DISCLOSURE OF THE INVENTION

An object of the present invention is to provide a folding bed so as to resolve the technical problem that the comfort degree of the folding beds is relatively low in the prior art.

The folding bed provided in the present invention includes a support frame and an air mattress; the air mattress is arranged on the support frame; the support frame is used to support the air mattress.

Furthermore, the support frame includes a fixing frame, a movable frame and a first fixing structure; the fixing frame is rotationally connected with the movable frame; the first fixing structure is arranged on the fixing frame and the movable frame for fixing the movable frame with the fixing frame after the movable frame is rotated relative to the fixing frame by a predetermined angle.

Furthermore, the first fixing structure includes a fixing part provided with a fixing hole and a first fixing protrusion used to be snapped in the fixing hole; the first fixing protrusion is provided on the movable frame; the fixing part is provided on the fixing frame.

Furthermore, the first fixing structure further includes a spring; the movable frame is provided with a groove; the first fixing protrusion has one end arranged in the groove, and the other end used to be snapped in the fixing hole; the spring has one end connected with a bottom wall of the groove, and the other end connected with the first fixing protrusion.

Furthermore, the fixing part includes a first side wall and a second side wall provided in parallel at an interval; the first fixing protrusion is in number of two; the movable frame includes a movable rod; both the first side wall and the second side wall are provided with a plurality of the fixing holes; the movable rod is rotationally connected with the first side wall and the second side wall via a rotation shaft; all of the plurality of fixing holes on the first side wall and the second side wall are distributed in a circular arc shape with the rotation shaft as a circle center; the two first fixing protrusions are symmetrically arranged on both sides of the movable rod, and one of the two first fixing protrusions is used to be snapped in the fixing hole on the first side wall, and the other is used to be snapped in the fixing hole on the second side wall.

Furthermore, a supporting bracket is further included; the supporting bracket is arranged on one side of the support frame away from the air mattress for supporting the support frame.

Furthermore, the supporting bracket includes a connecting rod and two supporting parts; the two supporting parts are oppositely arranged on two sides of the support frame respectively; and two ends of the connecting rod are connected with one of the supporting parts respectively.

Furthermore, the air mattress is detachably connected with the support frame.

Furthermore, the air mattress is provided with a hook for hanging on the support frame.

Furthermore, the support frame includes: a supporting body and a fixing mechanism; the fixing mechanism includes an adjusting portion and a second supporting rod; the second supporting rod is used to fix the air mattress; the adjusting portion is arranged on the supporting body; the second supporting rod is fixed on the adjusting portion; the adjusting portion is used to adjust a position of the second supporting rod and unfold the air mattress.

Furthermore, the adjusting portion includes an adjusting part and a second fixing structure; the adjusting part is rotationally connected with the supporting body; the second supporting rod is fixedly connected with the adjusting part; the second fixing structure is able to have the adjusting part fixed with the supporting body after the adjusting part unfolds the air mattress.

Furthermore, the adjusting part includes an adjusting plate; the adjusting plate is provided with an arc-shaped slot for the second supporting rod to snap in.

Furthermore, the adjusting part includes a handle; and the handle is fixedly connected with the adjusting plate.

Furthermore, the fixing mechanism is in number of two; the two fixing mechanisms are arranged at an interval on the supporting body; and the two supporting rods are used to be fixedly connected with two opposite ends of the air mattress respectively.

Furthermore, the supporting body includes a U-shape rod; and the adjusting portion is connected with an upper end of the U-shape rod.

Furthermore, the supporting body includes a first sub-rod, a second sub-rod and a third sub-rod; the first sub-rod, the second sub-rod and the third sub-rod are detachably fixed and connected in sequence so as to form the U-shape rod; and the adjusting portion is arranged on an upper end of the first sub-rod.

Furthermore, the supporting body includes a third connector, a fourth connector and an elastic element; the third connector is provided with a first connecting hole and a second connecting hole; the fourth connector is provided with a third connecting hole and a fourth connecting hole; a lower end of the first sub-rod is inserted in the first connecting hole; both ends of the second sub-rod are respectively inserted in the second connecting hole and the third connecting hole; a lower end of the third sub-rod is inserted in the fourth connecting hole; one end of the elastic element is fixedly connected with an inner wall of the second connecting hole, and the other end passes through the second sub-rod and fixedly connected with an inner wall of the third connecting hole.

Furthermore, the air mattress is made from a composite fabric consisting of TPU, PVC or EVA The folding bed provided in the present invention includes the support frame and the air mattress, the air mattress being arranged on the support frame, and the support frame supporting the air mattress. When the user lies on the air mattress, the air mattress touches the back of the human body. Since the air mattress is internally filled with air, the air mattress is relatively soft when supporting the back of the human body, thus the comfort degree of the folding bed is improved.

DETAILED DESCRIPTION OF EMBODIMENTS

Technical solutions of the present invention will be described clearly and completely in conjunction with the figures. Apparently, some but not all of the examples of the present invention are described. Based on the examples of the present invention, all the other examples, which a person ordinarily skilled in the art obtains without paying inventive effort, fall within the scope of protection of the present invention.

In the description of the present invention, it should be noted that orientational or positional relationships indicated by terms such as "upper", "lower", "inner", and "outer" are based on orientational or positional relationships as shown in the figures, merely for facilitating describing the present invention and simplifying the description, rather than indicating or suggesting that related devices or elements have to be in the specific orientation or configured and operated in specific orientation, therefore, they should not be construed as limiting the present invention. Besides, terms such as "first", "second" and "third" are merely for descriptive purpose, but should not be construed as indicating or implying relative importance.

In the description of the present invention, it should be indicated that unless otherwise specified and defined, terms "mount", "join", and "connect" should be understood in a broad sense, for example, it can be a fixed connection, a detachable connection, or an integrated connection; it can be a mechanical connection or an electrical connection; and it can be a direct connection or an indirect connection through an intermediate medium; and also can be an inner communication between two elements. For a person ordinarily skilled in the art, specific meanings of the above-mentioned terms in the present invention can be understood according to specific circumstances.

First Example

Figure 1:
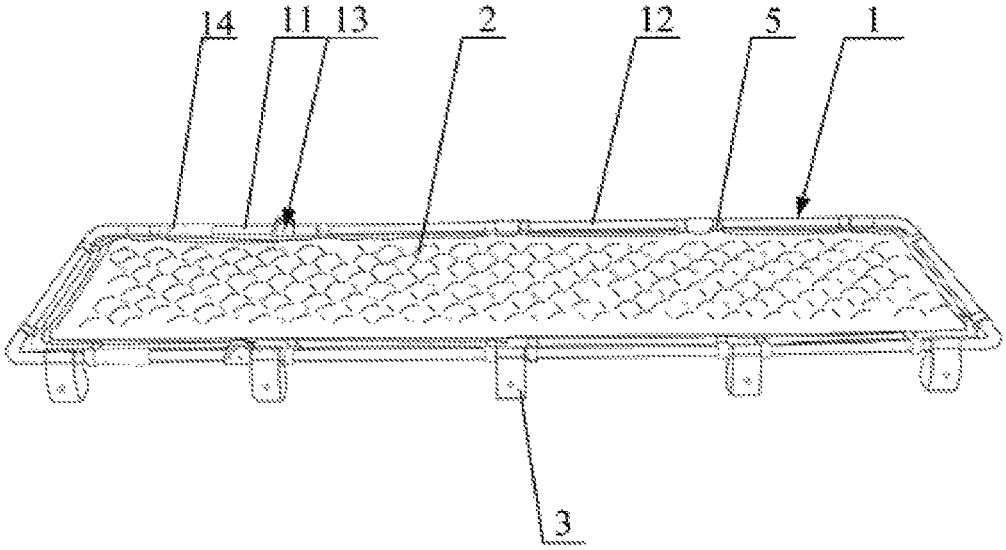
FIG. 1 is a structural schematic diagram of a folding bed provided in a first example of the present invention.

FIG. 1 is a structural schematic diagram of a folding bed provided in a first example of the present invention. As shown in FIG. 1, the folding bed provided in the present example includes: a support frame 1 and an air mattress 2; the air mattress 2 is arranged on the support frame 1; the support frame 1 is used to support the air mattress 2.

The air mattress 2 is a cushion internally filled with air. The air mattress 2 also can be provided with a plurality of connecting portions. There is no air at the connecting portions so as to form recessed portions. The plurality of connecting portions separate the air mattress 2 into a plurality of protruded portions. When a user lies on the air mattress 2, due to the provision of the recessed portions and the protruded portions, there are gaps between the back of the human body and the air mattress 2, and external air can pass through the gaps between the back of the human body and the air mattress 2, thereby improving air-permeability of the air mattress 2 in use.

The material of the support frame 1 can be of multiple types, for example, plastic, stainless steel and aluminum alloy. Optionally, the material of the support frame 1 is aluminum alloy which has high intensity and light weight, so that the user can conveniently carry the support frame 1. The support frame 1 also can be assembled by air-filled pipes.

The support frame 1 also can be provided with straps, and the user lifts up a fixing frame via the straps, which is convenient to exert force.

The folding bed provided in the present example includes the support frame 1 and the air mattress 2, the air mattress 2 is arranged on the support frame 1, and the support frame 1 supports the air mattress 2. When the user lies on the air mattress 2, the air mattress 2 is in touch with the back of the human body. Since the air mattress 2 is internally filled with air, the air mattress 2 is relatively soft when supporting the back of the human body, thus the comfort degree of the folding bed is improved.

Figure 2:
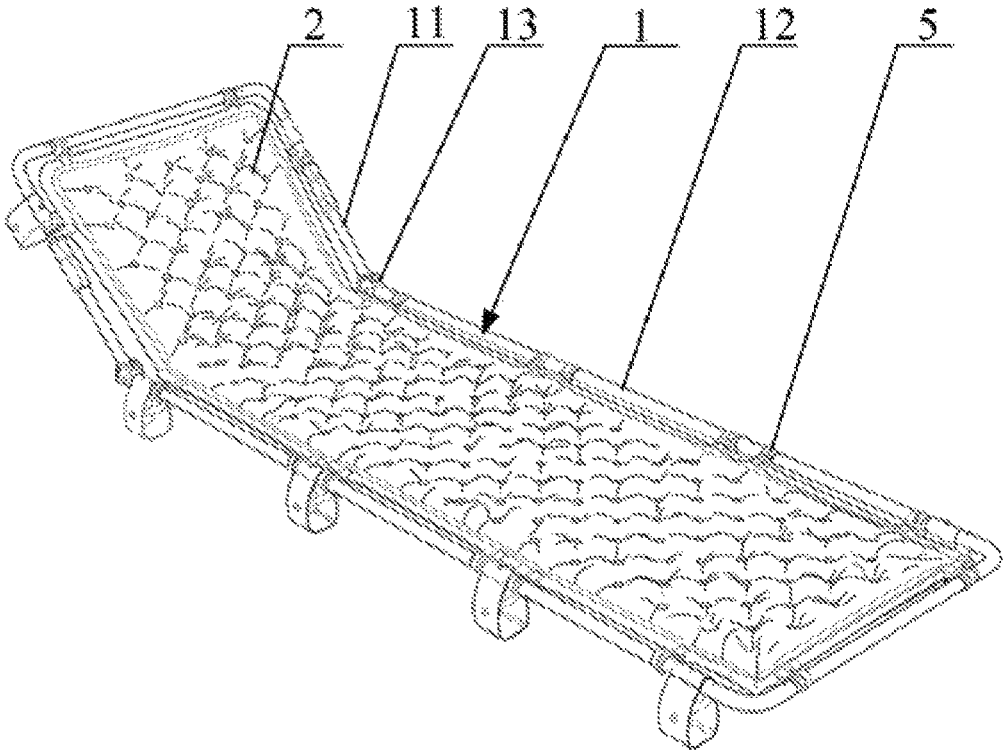
FIG. 2 is another structural schematic diagram of the folding bed provided in the first example of the present invention.
Figure 3:
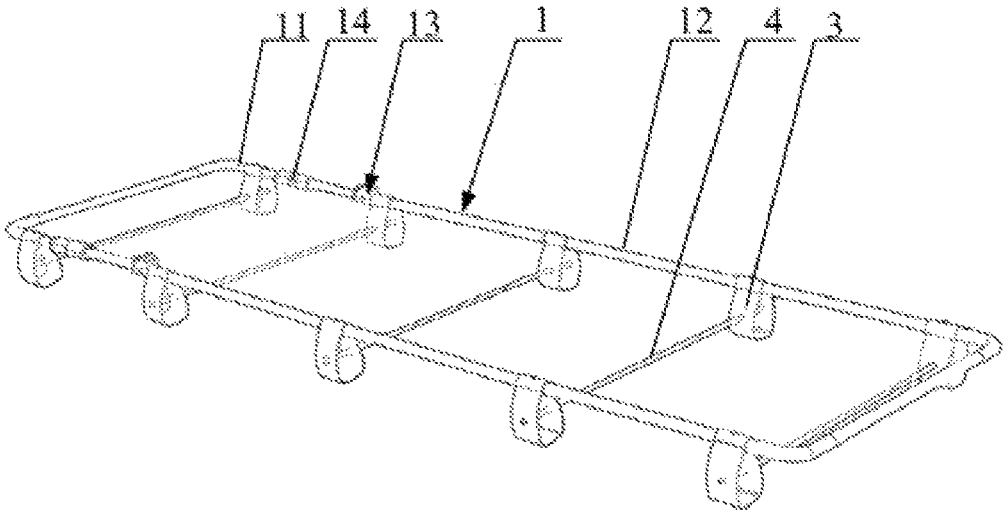
FIG. 3 is a structural schematic diagram of a support frame of the folding bed provided in the first example of the present invention.

FIG. 2 is another structural schematic diagram of the folding bed provided in the first example of the present invention, and FIG. 3 is a structural schematic diagram of the support frame 1 of the folding bed provided in the first example of the present invention. As shown in FIG. 2 and FIG. 3, on the basis of the above example, furthermore, the support frame 1 includes a fixing frame 12, a movable frame 11 and a first fixing structure 13; the fixing frame 12 is rotationally connected with the movable frame 11; the first fixing structure 13 is arranged on the fixing frame 12 and the movable frame 11 for fixing the movable frame 11 with the fixing frame 12 after the movable frame 11 is rotated relative to the fixing frame 12 by a predetermined angle.

Figure 6:
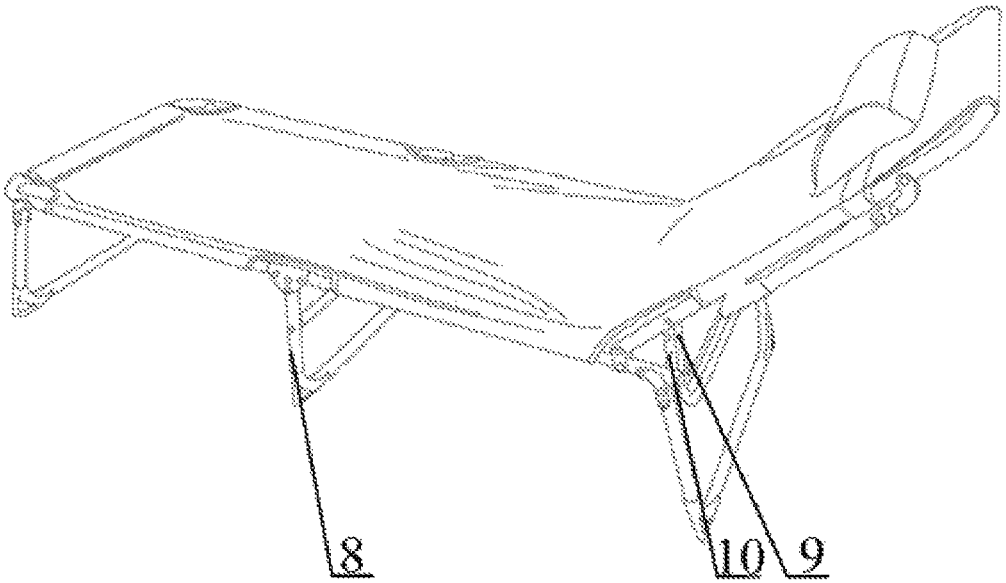
FIG. 6 is another structural schematic diagram of the supporting bracket of the folding bed provided in the first example of the present invention.

The structural form of the first fixing structure 13 can be of multiple types, for example, as shown in FIG. 6, the first fixing structure 13 includes an adjusting rod 9 and a fixing part, and the adjusting rod 9 is provided with a notch 10 for snapping with the fixing part. The adjusting rod 9 is arranged on the movable frame 11, and one end of the fixing part is connected with the fixing frame 12. After the user rotates the movable frame 11 by a predetermined angle, the fixing part is snapped in the notch 10, and the fixing part supports the movable frame 11 via the adjusting rod 9. Optionally, there are a plurality of notches 10, and the plurality of notches 10 are arranged in sequence on the adjusting rod 9 at intervals along an extending direction of the adjusting rod 9. The user can choose to snap fit the fixing part in one of the notches 10. When the user snap fits the fixing part in different notches 10, the angle between the movable frame 11 and the horizontal plane is different, so that the movable frame 11 can be rotated by a plurality of angles.

The first fixing structure 13 includes a hook 5 and a hook hole. The hook hole is provided on the fixing frame 12, and the hook 5 is provided on the movable frame 11. After the user rotates the movable frame 11 by a predetermined angle, the hook 5 will be hanged in the hook hole so as to fix the movable frame 11 with the fixing frame 12.

Figure 7:
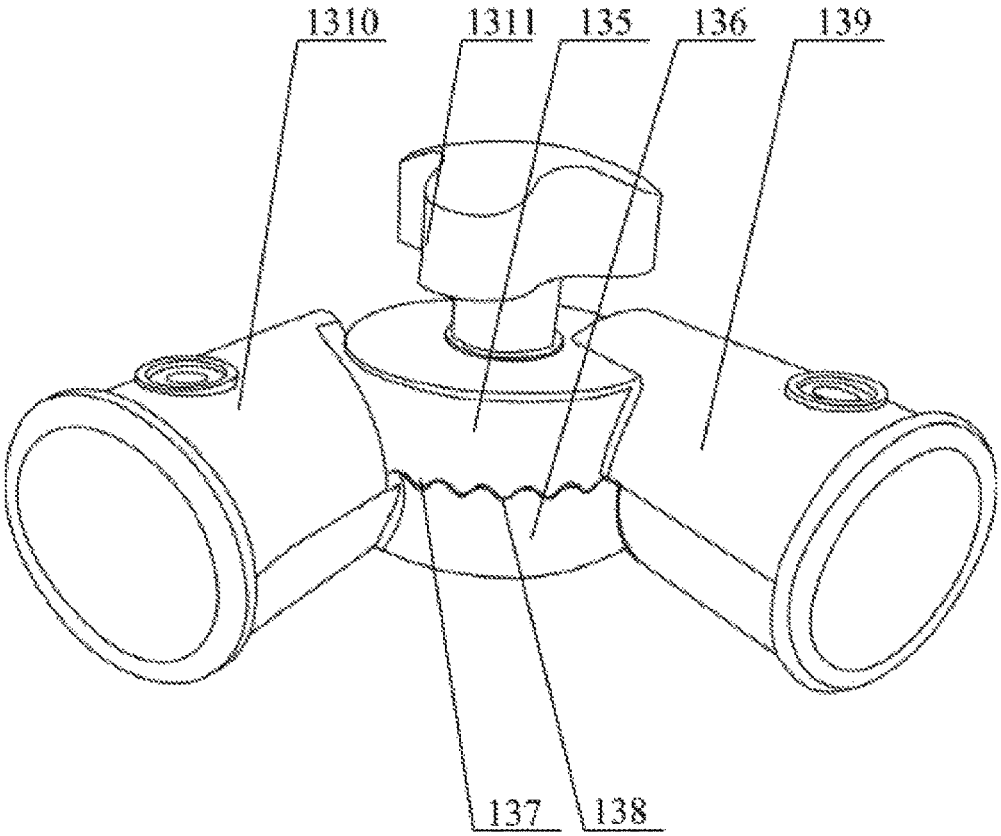
FIG. 7 is another structural schematic diagram of the first fixing structure of the folding bed provided in the first example of the present invention.

FIG. 7 is another structural schematic diagram of the first fixing structure 13 of the folding bed provided in the first example of the present invention. As shown in FIG. 7, the first fixing structure 13 further can include a movable tube 135 open at one end and a fixing tube 136 open at one end. On an edge of the opening end of the movable tube 135, a plurality of engagement protrusions 137 are provided in sequence at intervals along a circumferential direction of the movable tube 135; on an edge of the opening end of the fixing tube 136, a plurality of grooves 138 are provided in sequence at intervals along a circumferential direction of the fixing tube 136; each engagement protrusion 137 is engaged in one groove 138, and the movable tube 135 is detachably fixed and connected with the fixing tube 136. The movable tube 135 is connected with the movable frame, and the fixing tube 136 is connected with the fixing frame. The user separates the movable tube 135 from the fixing tube 136, and then rotates the movable tube 135 relative to the fixing tube 136 by a predetermined angle, so that the movable frame is rotated relative to the fixing frame by the predetermined angle, and then the engagement protrusions 137 on the movable tube 135 are engaged in the grooves 138 on the fixing tube 136, then the movable tube 135 is fixed with the fixing tube 136, so as to realize the rotation of the movable frame.

Furthermore, a spring can be further provided, and one end of the spring abuts against an inner bottom wall of the movable tube 135, and the other end abuts against an inner bottom wall of the fixing tube 136. The elastic force of the spring can make it easy for the user to separate the movable tube 135 from the fixing tube 136. A first connector 139 can be further provided on the movable tube 135, and the movable tube 135 is connected with the movable frame via the first connector 139. A second connector 1310 is provided on the fixing tube 136, and the fixing tube 136 is connected with the fixing frame via the second connector 1310. Both the first connector 139 and the second connector 1310 are in a tubular shape, and one end of the first connector 139 is connected with the movable tube 135; one end of the second connector 1310 is connected with the fixing tube 136; both the movable frame and the fixing frame are U-shape rods, and the movable tubes 135, the fixing tubes 136, the first connectors 139 and the second connectors 1310 are in number of two, respectively. Both opening ends of the movable frame are respectively snapped in one first connector 139, and both opening ends of the fixing frame are respectively snapped in one second connector 1310. An adjusting handle 1311 can be further provided, one end of the adjusting handle 1311 is fixedly connected with the movable tube 135, and the other end is detachably fixed and connected with the fixing tube 136. Firstly, the user detaches and separates the adjusting handle 1311 from the fixing tube 136, then rotates the adjusting handle 1311, so that the movable tube 135 is rotated relative to the fixing tube 136 by a predetermined angle. When adjusting the angle of the movable frame, the adjusting handle 1311 can make it easy for the user to exert force on the movable frame. Optionally, both the fixing frame 12 and the movable frame 11 are in a U shape, and the opening end of the fixing frame 12 is rotationally connected with the opening end of the movable frame 11.

Furthermore, a holding portion 14 can be further provided on the movable frame 11, and the user can hold the holding portion 14 with a hand to rotate the movable frame 11 to increase the friction between the hand of the human body and the support frame 1, and making it easy for the user to exert force. The material of the holding portion 14 can be a rubber, so that the holding portion 14 is relatively soft, and the comfort degree is improved when the user rotates the movable frame 11.

In the present example, the support frame 1 includes the fixing frame 12 and the movable frame 11, and the movable frame can be rotated relative to the fixing frame 12. Before use, the user can rotate the movable frame 11 by a predetermined angle, so that the movable frame 11 and the fixing frame 12 are arranged with an angle therebetween. Then, the user sits on the fixing frame 12, with the user's back leaning on the movable frame 11, which further improves the comfort degree of the folding bed.

Figure 4:
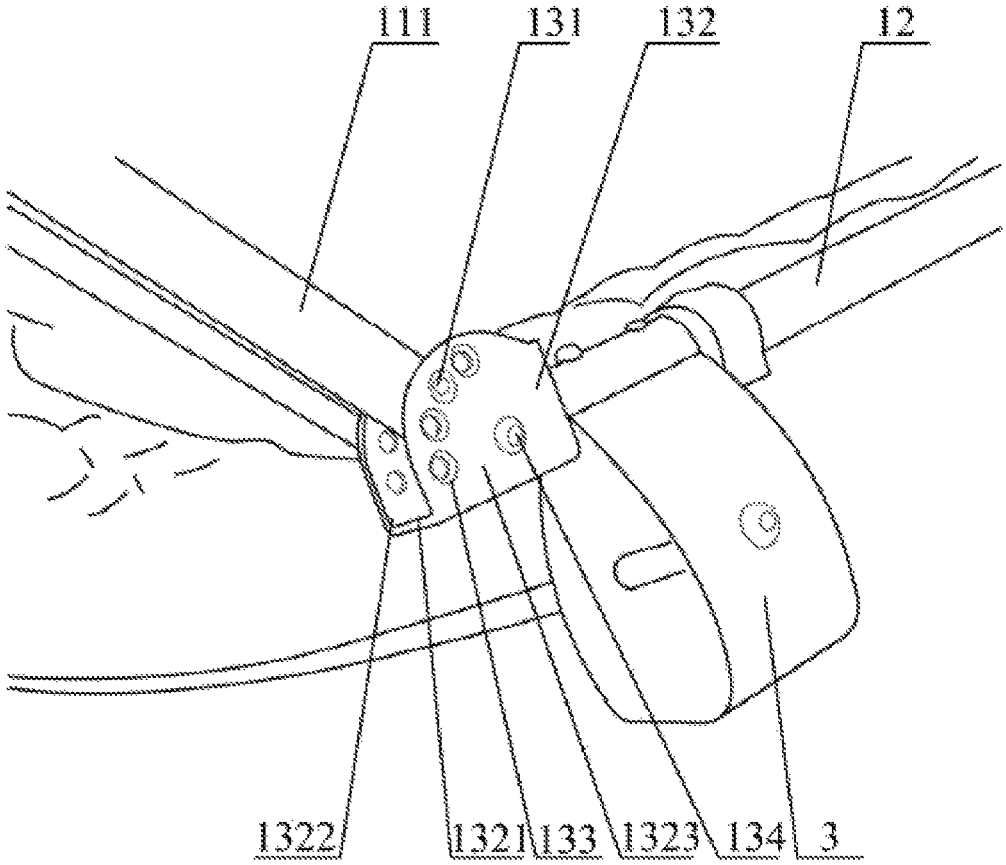
FIG. 4 is an enlarged view of a first fixing structure of the folding bed provided in the first example of the present invention.

FIG. 4 is an enlarged view of the first fixing structure of the folding bed provided in the first example of the present invention. As shown in FIG. 2 and FIG. 4, on the basis of the above example, furthermore, the first fixing structure 13 includes a fixing part 132 provided with a fixing hole 133 and a first fixing protrusion 131 used to be snapped in the fixing hole 133; the first fixing protrusion 131 is provided on the movable frame 11; the fixing part 132 is provided on the fixing frame 12.

The first fixing protrusion 131 and the fixing hole 133 can be in number of one or two, respectively. Preferably, the first fixing protrusions 131 and the fixing holes 133 are in number of two respectively, and the two first fixing protrusions 131 are arranged at an interval along a width direction of the fixing frame 12, and optimally, the two first fixing protrusions 131 are symmetrically arranged on both sides of the fixing frame 12, thus the movable frame 11 can be supported by the two first fixing protrusions 131, so that the movable frame 11 is under balanced forces.

In the present example, after the user rotates the movable frame 11 by a predetermined angle, the first fixing protrusion 131 is snapped in the fixing hole 133, so that the movable frame 11 is fixed with the fixing frame 12. The structure is simple, and it is easy for the user to operate.

On the basis of the above example, furthermore, the first fixing structure 13 further includes a spring; the movable frame 11 is provided with a groove; one end of the first fixing protrusion 131 is arranged in the groove, and the other end is used to be snapped in the fixing hole 133; one end of the spring is connected with a bottom wall 1321 of the groove, and the other end is connected with the first fixing protrusion 131.

In the present example, during the process of the user rotating the movable frame 11, the first fixing protrusion 131 abuts against the fixing part 132, when the first fixing protrusion 131 is rotated to the fixing hole 133, the spring presses the first fixing protrusion 131 towards the outside of the groove, so that the first fixing protrusion 131 is snapped in the fixing hole 133, at which time the movable frame 11 is fixed with the fixing frame 12. When the movable frame 11 needs to be restored, the user can press the first fixing protrusion 131, so that the first fixing protrusion 131 moves out from the fixing hole 133, and then the user rotates the movable frame 11.

In the present example, the spring is arranged in the groove, and the first fixing protrusion 131 is snapped in the fixing hole 133 via a compression of the spring, which facilitates the user's operation.

As shown in FIG. 4, on the basis of the above example, furthermore, the fixing part 132 includes a first side wall 1322 and a second side wall 1323 provided in parallel at an interval; the first fixing protrusions 131 is in number of two; the movable frame 11 includes a movable rod 111.

Both the first side wall 1322 and the second side wall 1323 are provided with a plurality of fixing holes 133; the movable rod 111 is rotationally connected with the first side wall 1322 and the second side wall 1323 via a rotation shaft 134; all of the plurality of fixing holes 133 on the first side wall 1322 and the second side wall 1323 are distributed in a circular arc shape with the rotation shaft 134 as a center.

The two first fixing protrusions 131 are symmetrically arranged on both sides of the movable rod, and one of the two first fixing protrusions 131 is used to be snapped in the fixing hole 133 on the first side wall 1322, and the other is used to be snapped in the fixing hole 133 on the second side wall 1323.

A bottom wall 1321 further can be provided, and the first side wall 1322 and the second side wall 1323 can be perpendicularly connected with the bottom wall 1321, and also can be connected with an acute angle therebetween. Optionally, the first side wall 1322 and the second side wall 1323 are perpendicularly connected with the bottom wall 1321, so that a gap between the first side wall 1322 and the second side wall 1323 can be reduced, further a space occupied by the fixing part 132 is reduced.

A radian of a circular arc formed by the plurality of fixing holes 133 can be of any degree. Optionally, this radian is of 90°, that is, this circular arc is an one-fourth circle. When the first fixing protrusions 131 are snapped in the fixing holes 133 at both ends, the movable frame 11 is parallel to or perpendicular to the fixing frame 12, that is, at this time, the movable frame 11 is parallel to or perpendicular to the horizontal plane. When the first fixing protrusion 131 is snapped in any one of the fixing holes 133 between the fixing holes 133 at both ends, the movable frame 11 and the fixing frame 12 have an acute angle therebetween.

In the present example, a plurality of fixing holes 133 are distributed in a circular arc shape. When the user rotates the movable frame 11, the user can choose to snap the first fixing protrusion 131 in one of the fixing holes 133, so that the movable frame 11 can be rotated by a plurality of angles, facilitating the user's use.

On the basis of the above example, furthermore, the folding bed further includes a supporting bracket; the supporting bracket is arranged on the side of the support frame 1 away from the air mattress 2 for supporting the support frame 1.

Figure 5:
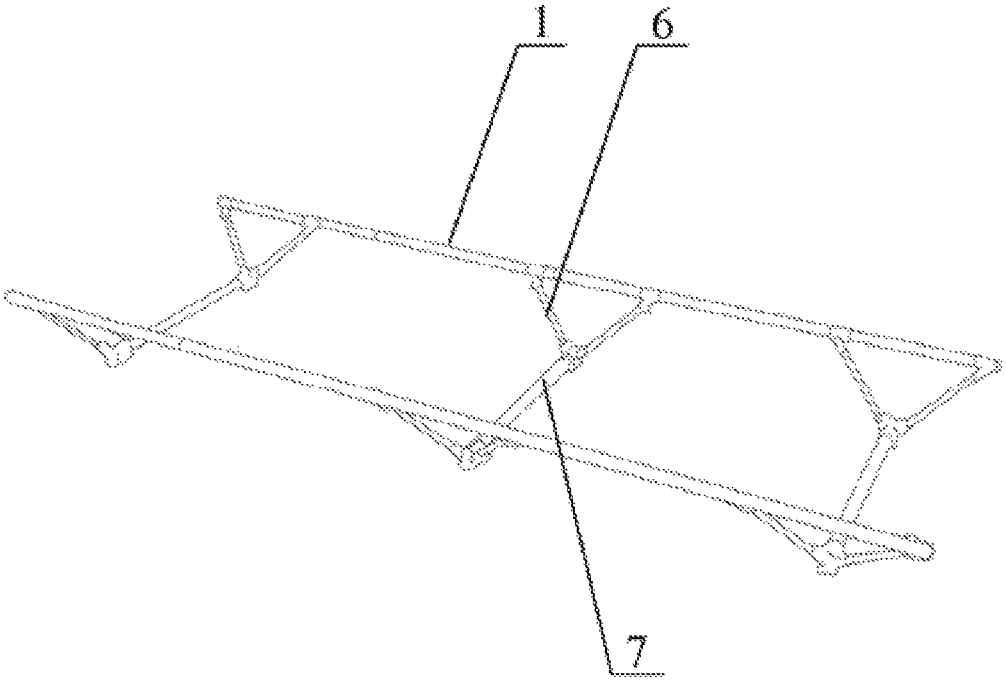
FIG. 5 is a structural schematic diagram of a supporting bracket of the folding bed provided in the first example of the present invention.

The structural form of the supporting bracket can be of multiple types, for example, as shown in FIG. 5, the supporting bracket includes a plurality of supporting portions; the plurality of supporting portions are arranged at equal intervals along the width and length directions of the support frame 1. Each supporting portion includes two first supporting rods 6 arranged with an acute angle therebetween, where one end of one first supporting rod 6 is connected with one end of the other supporting rod 6, and the other ends of the two first supporting rods 6 are connected with the support frame 1. The supporting bracket further can include a plurality of fixing rods 7, both ends of each fixing rod 7 are respectively connected with two supporting portions, and both ends of each fixing rod 7 are respectively connected with one end of the first supporting rod 6 away from the support frame 1.

As shown in FIG. 6, the supporting bracket further can include a plurality of U-shape first supporting rods 8, and the plurality of U-shape first supporting rods 8 are arranged in sequence at intervals along the length direction of the support frame 1. An opening end of each U-shape first supporting rod 8 is connected with the support frame 1. Optionally, each U-shape first supporting rod 8 is arranged to have an acute angle with the support frame 1, thus the stability of the supporting bracket can be further improved, preventing the support frame 1 from toppling over.

In the present example, the supporting bracket is arranged on the side of the support frame 1 away from the air mattress 2, and the supporting bracket is used to support the support frame 1, so that there is a distance between the air mattress 2 and the ground. When the user lies on the air mattress 2, there is a distance between the back of the user and the ground, so that the back of the user can be prevented from touching the ground to bump against the ground after the user lies on the air mattress 2, further improving the comfort degree of the folding bed.

On the basis of the above example, furthermore, the supporting bracket includes a connecting rod 4 and two supporting parts 3; the two supporting parts 3 are oppositely arranged on both sides of the support frame 1; both ends of the connecting rod 4 are connected with one supporting part 3 respectively.

The two supporting parts 3 can be arranged at an interval along the width direction of the support frame 1.

Two supporting parts 3 form one group. The connecting rods 4 can be in number of more than one. There are a plurality of groups of supporting parts 3. The plurality of groups of supporting parts 3 and more than one of connecting rods 4 are arranged in sequence at intervals along the length direction of the support frame 1. Thus, the stability of the supporting bracket can be improved when supporting the support frame 1.

In the present example, the connecting rods 4 are arranged between the two supporting parts 3. After the user lies on the air mattress 2, the gravity of the user is exerted on the support frame 1, at this time, since the supporting parts 3 are located on both sides of the support frame 1, the supporting parts 3 tend to move towards a direction away from the support frame 1. However, at this time, the connecting rods 4 apply acting forces to the supporting parts 3 to get close to the support frame 1, so that the supporting parts 3 are fixed in situ, which further improves the stability of the supporting bracket.

As shown in FIG. 1 and FIG. 2, on the basis of the above example, furthermore, the air mattress 2 is detachably connected with the support frame 1.

In the present example, since the air mattress 2 is detachably connected with the support frame 1, the user can detach the air mattress 2 from the support frame 1, so that the air mattress 2 can be used separately, further facilitating the user's use.

As shown in FIG. 1 and FIG. 2, on the basis of the above example, furthermore, the air mattress 2 is provided with a hook 5 for hanging on the support frame 2.

The hooks 5 is in number of more than one. All of the hooks 5 are arranged in sequence at intervals along an edge of the air mattress 2.

In the present example, with the hooks 5, detachable connection between the air mattress 2 and the support frame 1 is realized, which has a simple structure and facilitates user's operation.

On the basis of the above example, furthermore, the air mattress 2 is made from a composite fabric consisting of TPU, PVC or EVA.

In the present example, the material of the air mattress can be TPU (thermoplastic polyurethane), PVC (polyvinyl chloride) or EVA (ethylene-vinyl acetate copolymer), that is, the material of the air mattress can be a TPU composite fabric, a PVC composite fabric or an EVA composite fabric, so that the tensile property of the air mattress is relatively strong, and the service life of the air mattress 2 is prolonged.

Second Example

A second example of the present invention provides a folding bed, including a support frame and a mattress, the support frame being used to support this mattress. Only the structure of the support frame is illustrated in the figure. Below the structure of the support frame is explained.

Figure 8:
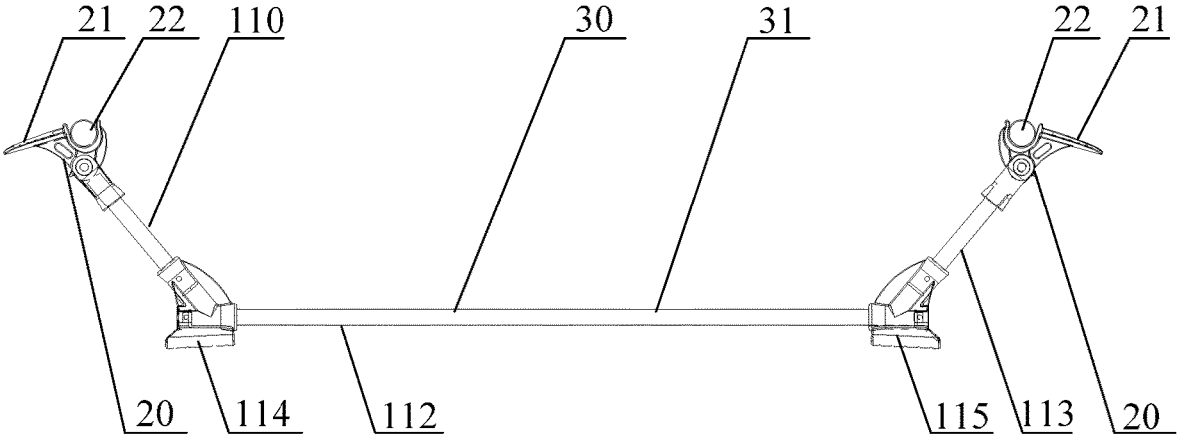
FIG. 8 is a structural schematic diagram of a support frame of the folding bed provided in a second example of the present invention.
Figure 9:
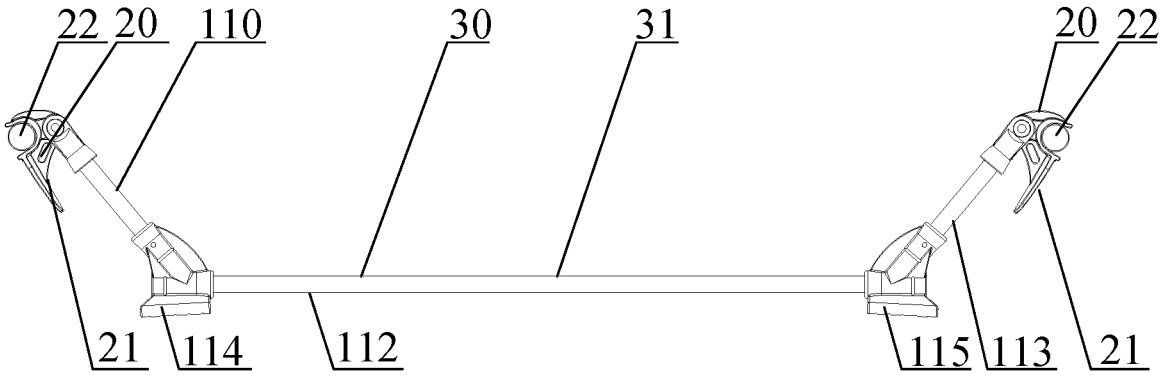
FIG. 9 is another structural schematic diagram of the support frame of the folding bed provided in the second example of the present invention

FIG. 8 is a structural schematic diagram of the support frame of the folding bed provided in the second example of the present invention; FIG. 9 is another structural schematic diagram of the support frame of the folding bed provided in the second example of the present invention. As shown in FIG. 8 and FIG. 9, in the present example, the support frame includes: a supporting body 30 and a fixing mechanism 20; the fixing mechanism 20 includes an adjusting portion 21 and a second supporting rod 22; the second supporting rod 22 is used to fix the mattress; the adjusting portion 21 is arranged on the supporting body 30; the second supporting rod 22 is fixed on the adjusting portion 21; the adjusting portion 21 is used to adjust the position of the second supporting rod 22 so as to unfold the mattress.

In the present example, the support frame includes the supporting body 30 and the fixing mechanism 20, and the fixing mechanism 20 includes the adjusting portion 21 and the second supporting rod 22. In use, the user fixes one end of the mattress on the second supporting rod 22, and fixes the other end on the supporting body 30, then adjusts the position of the second supporting rod 22 via the adjusting portion 21, so as to increase the interval between both ends of the mattress, and further unfold the mattress.

In the present example, the mattress is unfolded via the adjusting portion 21 and the second supporting rod 22 provided to the support frame, so as to avoid looseness of the mattress, and improve the comfort degree when people lie thereon.

The structural form of the adjusting portion 21 can be of multiple types, for example, the adjusting portion 21 includes a slider and a supporting block, the supporting block being provided with a plurality of sliding grooves for snapping with the slider. The slider is snap fitted in a corresponding sliding groove by the user so as to adjust the second supporting rod 22 to a corresponding position.

In the present example, the support frame is used in cooperation with the mattress. The mattress can be a separate single layer of cloth, a separate single layer of mesh, an inflatable bed or an automatic inflatable sponge bed. In the present example, this mattress is an air mattress 2. When the user lies on the air mattress 2, the air mattress 2 is in touch with the back of the human body. Since the air mattress 2 is internally filled with air, the air mattress 2 is relatively soft when supporting the back of the human body, thus the comfort degree of the folding bed is improved.

On the basis of this example, furthermore, the adjusting portion 21 includes an adjusting part and a second fixing structure; the adjusting part is rotationally connected with the supporting body 30; the second supporting rod 22 is fixedly connected with the adjusting part; after the adjusting part unfolds the mattress, the second fixing structure can fix the adjusting part with the supporting body 30.

In the present example, the adjusting part is rotated relative to the supporting body 30 to adjust the position of the second supporting rod 22, so that the mattress is unfolded, at this time, the adjusting part is fixed with the supporting body 30 via the second fixing structure, to prevent the adjusting part from rotating reversely, and ensure the stability of the support frame.

The shape of the adjusting part can be of multiple types, for example, a square shape, a circular shape, and an irregular shape.

The structural form of the second fixing structure can be of multiple type, for example, the second fixing structure includes a second fixing protrusion 25 and a fixing groove; the second fixing protrusion 25 is arranged on the adjusting part; the fixing groove is arranged on the supporting body 30. When the adjusting part is rotated to a predetermined position, the second fixing protrusion 25 is snapped in the fixing groove, so as to fix the adjusting part with the supporting body 30.

Figure 10:
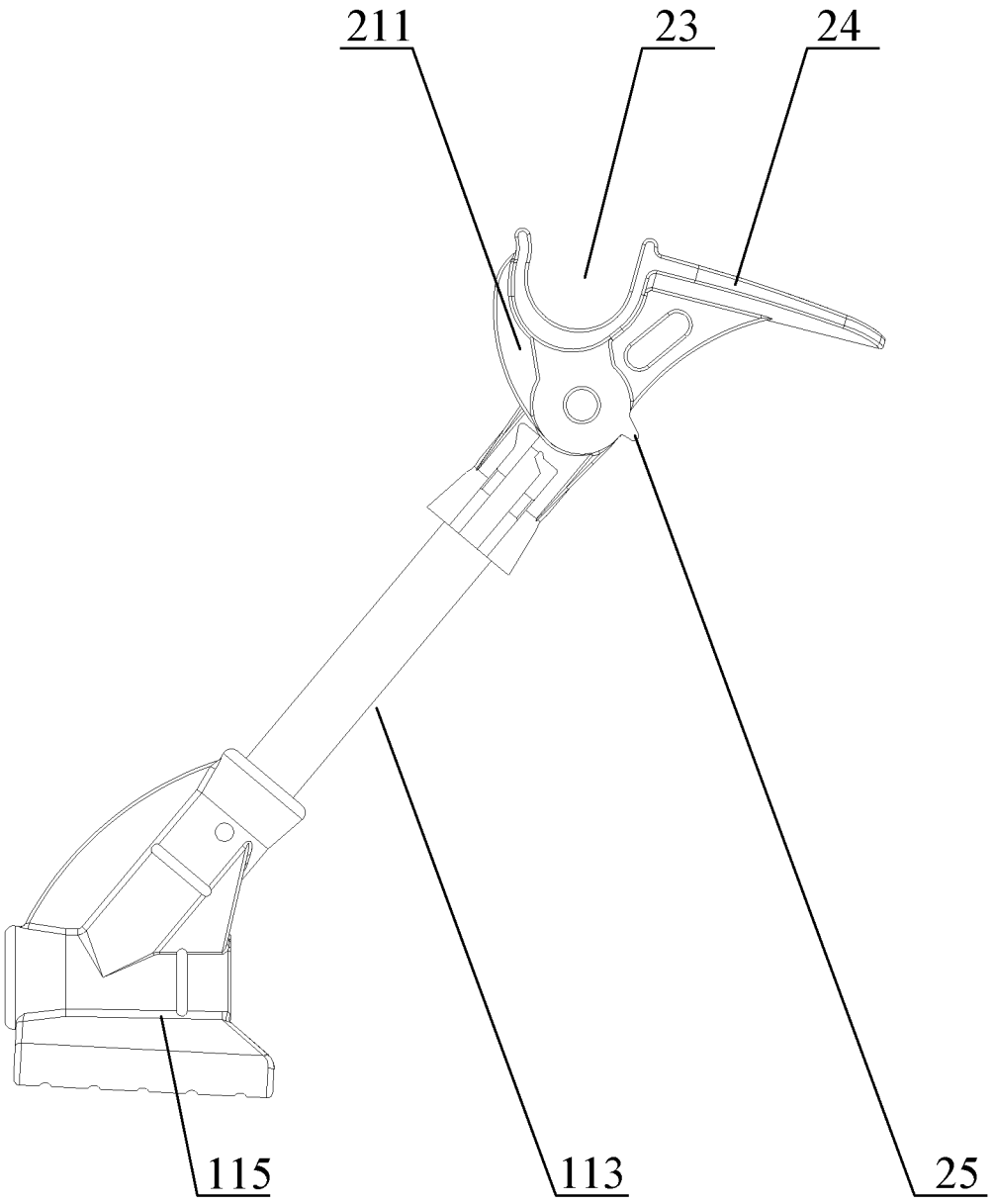
FIG. 10 is a structural schematic diagram showing that an adjusting portion of the support frame shown in FIG. 8 is in a first position.
Figure 11:
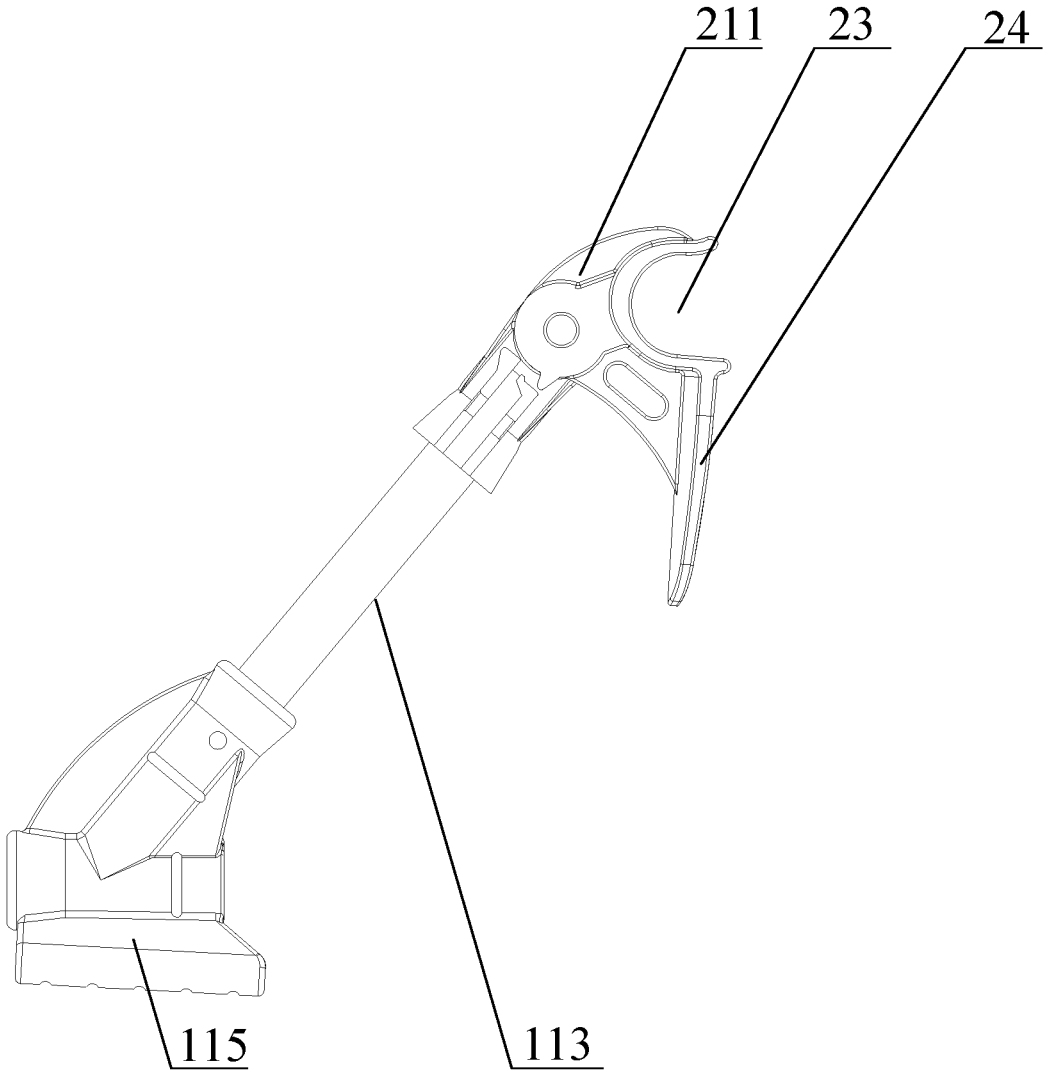
FIG. 11 is a structural schematic diagram showing that the adjusting portion of the support frame shown in FIG. 8 is in a second position.
Figure 12:
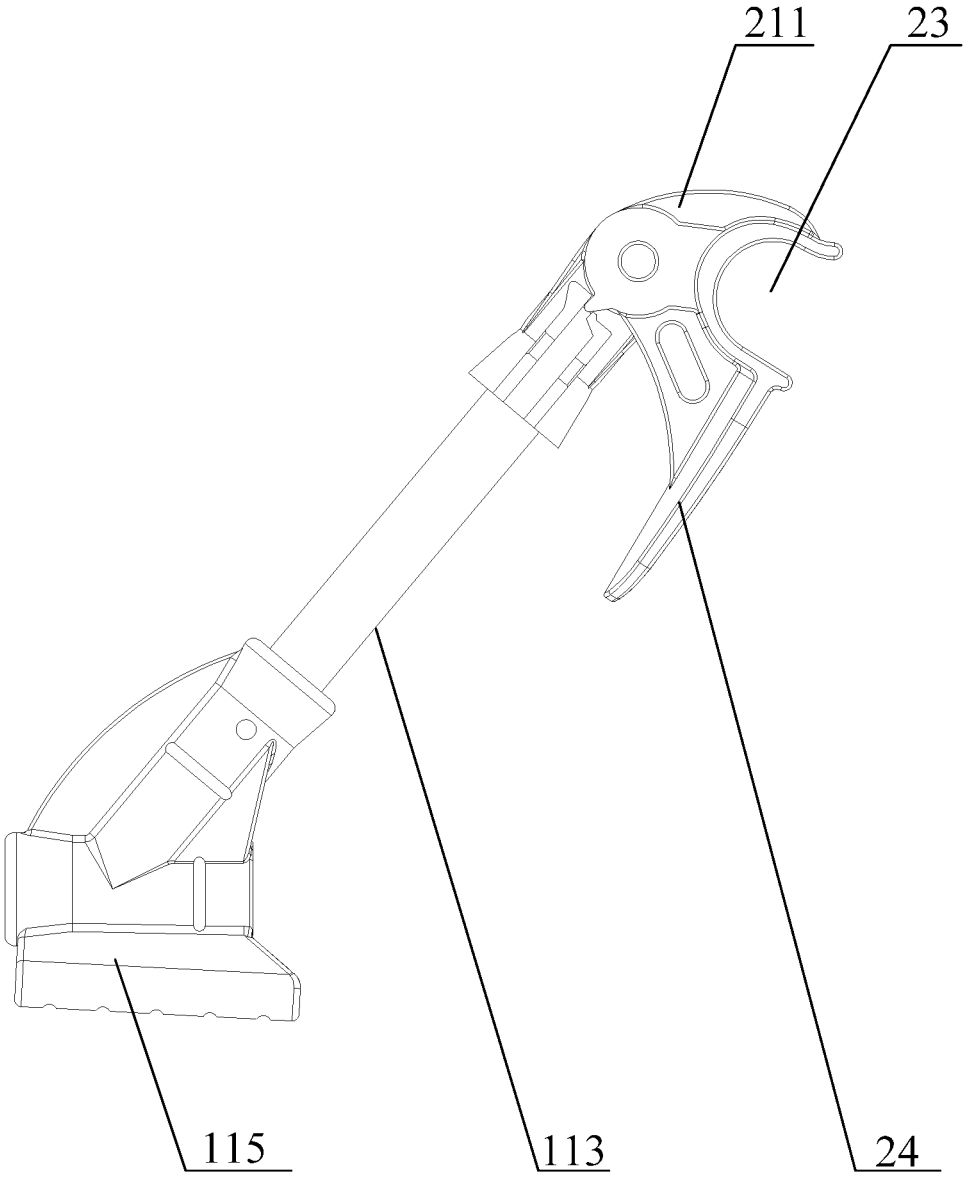
FIG. 12 is a structural schematic diagram showing that the adjusting portion of the support frame shown in FIG. 8 is in a third position.

FIG. 10 is a structural schematic diagram showing that the adjusting portion of the support frame shown in FIG. 8 is in a first position; FIG. 11 is a structural schematic diagram showing that the adjusting portion of the support frame shown in FIG. 8 is in a second position; FIG. 12 is a structural schematic diagram showing that the adjusting portion of the support frame shown in FIG. 8 is in a third position. As shown in FIG. 8 to FIG. 12, on the basis of the above examples, furthermore, the adjusting part includes an adjusting plate 211; the adjusting plate 211 is provided with an arc-shaped slot 23 for snapping with the second supporting rod 22.

In the present example, the user snaps the second supporting rod 22 in the arc-shaped slot 23, the adjusting plate 211 is rotated, and thereby driving the second supporting rod 22 to move, so as to adjust the position of the second supporting rod 22, the structure is simple, facilitating the installation of the second supporting rod 22.

Optionally, the arc-shaped slot 23 has a shape of semi-circular.

As shown in FIG. 10 to FIG. 12, on the basis of the above example, furthermore, the adjusting part includes a handle 24; the handle 24 is fixedly connected with the adjusting plate 211.

In the present example, the user holds the handle 24 with a hand, and then rotates the adjusting plate 211 to adjust the position of the second supporting rod 22. The provision of the handle 24 makes it convenient for the user to exert force.

As shown in FIG. 8, on the basis of the above example, furthermore, the fixing mechanisms 20 is in number of two; the two fixing mechanisms 20 are arranged at an interval on the supporting body 30; the two supporting rods 22 are used to be fixedly connected with two opposite ends of the mattress respectively.

In the present example, two fixing mechanisms 20 are provided, each adjusting portion 21 is fixed with one second supporting rod 22, and the user can enable the two supporting rods 22 to move towards directions away from each other via the two adjusting portions 21, that is, increase the interval between the two second supporting rods 22, so as to unfold the mattress. When the adjusting portion 21 includes the adjusting plate 211 and the handle 24, the two supporting rods 22 are respectively snapped in one arc-shaped slot 23, the user fixes both ends of the mattress on one second supporting rod 22, then rotates the adjusting plate 211 in turn, so that the second supporting rod 22 is moved towards a direction away from the other second supporting rod 22, thus increasing the distance between the two supporting rods 22, and unfolding the mattress.

Figure 13:
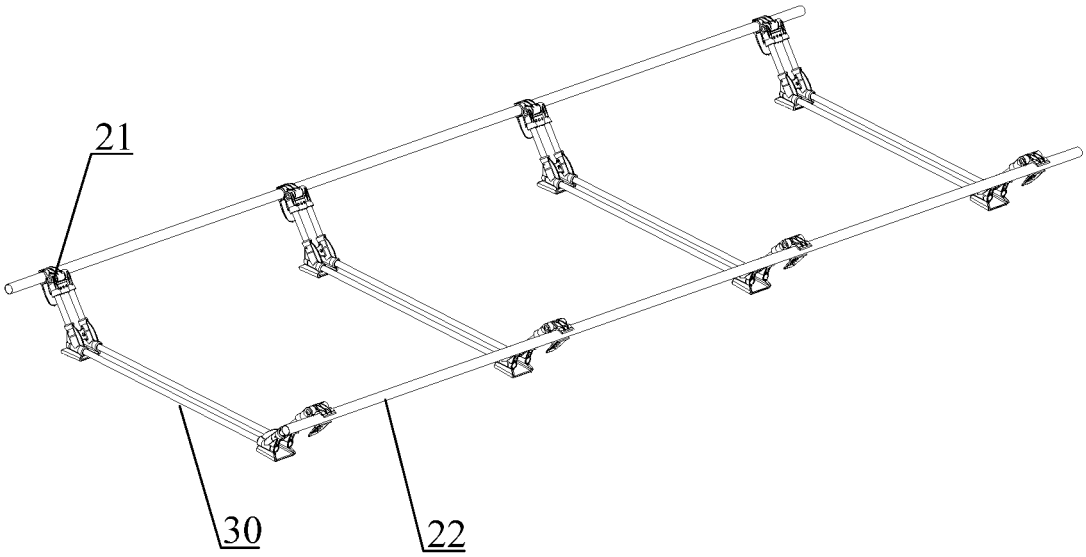
FIG. 13 is another structural schematic diagram of the support frame of the folding bed provided in the second example of the present invention.

FIG. 13 is another structural schematic diagram of the support frame of the folding bed provided in the second example of the present invention. As shown in FIG. 13, the supporting bodies 30 can be in number of more than one, all of the supporting bodies 30 are arranged in sequence at intervals along the length direction of the second supporting rod 22, both ends of each supporting body 30 are connected with one fixing portion, where one second supporting rod 22 is fixed on a plurality of adjusting portions 21 on one side of the supporting body 30, and the other second supporting rod 22 is fixed on a plurality of adjusting portions 21 on the other side of the supporting body 30.

As shown in FIG. 8 and FIG. 9, on the basis of the above example, furthermore, the supporting body 30 includes a U-shape rod 31; the adjusting portion 21 is connected with an upper end of the U-shape rod 31.

In the present example, the supporting body 30 is provided as the U-shape rod 31, which is of a simple structure and subjected to force stably, and makes it easy to be moved by the user.

Optionally, the U-shape rods 31 is in number of two, the two U-shape rods 31 are arranged in parallel, and the two U-shape rods 31 are fixedly connected. Furthermore, the supporting body 30 further includes two fixing parts, both ends of the two U-shape rods 31 are respectively fixed together via one fixing part. The adjusting plate 211 is hinged with the fixing part. The fixing groove is arranged on the fixing part.

As shown in FIG. 8 and FIG. 9, on the basis of the above example, furthermore, the supporting body 30 includes a first sub-rod 110, a second sub-rod 112 and a third sub-rod 113, the first sub-rod 110, the second sub-rod 112 and the third sub-rod 113 are detachably fixed and connected in sequence so as to form the U-shape rod 31; the adjusting portion 21 is arranged on an upper end of the first sub-rod 110.

In the present example, the first sub-rod 110, the second sub-rod 112 and the third sub-rod 113 are detachably fixed and connected in sequence so as to form the U-shape rod 31. After the user completes the use, the first sub-rod 110, the second sub-rod 112 and the third sub-rod 113 can be detached and placed, which reduces the volume of the support frame and facilitates the user's transportation.

Figure 14:
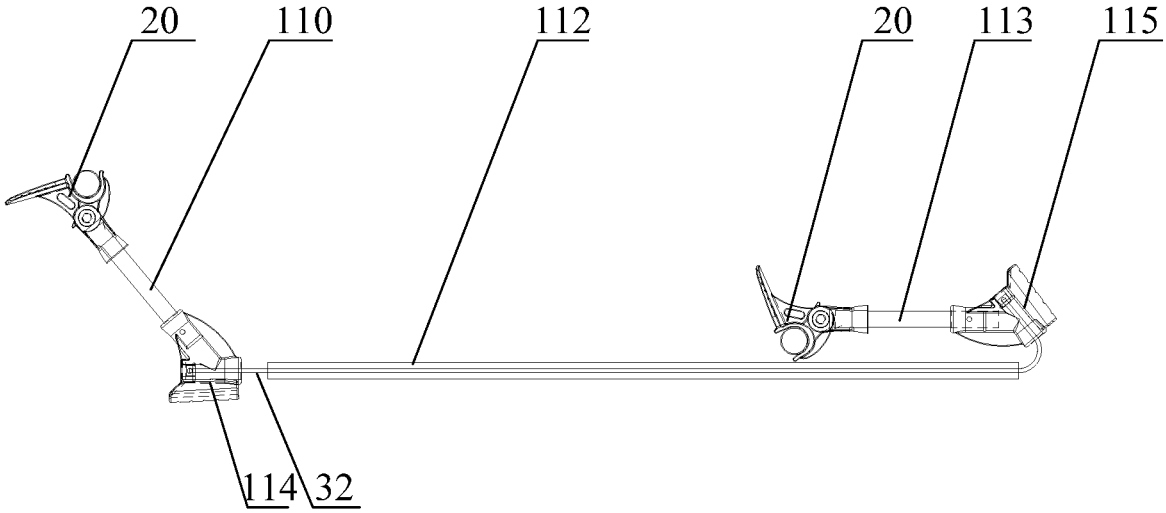
FIG. 14 is a third structural schematic diagram of the support frame of the folding bed provided in the second example of the present invention.

FIG. 14 is a third structural schematic diagram of the support frame of the folding bed provided in the second example of the present invention. As shown in FIG. 8, FIG. 9 and FIG. 14, on the basis of the above example, furthermore, the supporting body 30 includes a third connector 114, a fourth connector 115 and an elastic element 32; the third connector 114 is provided with a first connecting hole and a second connecting hole; the fourth connector 115 is provided with a third connecting hole and a fourth connecting hole; a lower end of the first sub-rod 110 is snapped in the first connecting hole; both ends of the second sub-rod 112 are respectively inserted in the second connecting hole and the third connecting hole; a lower end of the third sub-rod 113 is snapped in the fourth connecting hole; the elastic element 32 has one end fixedly connected with an inner wall of the second connecting hole, and the other end passing through the second sub-rod 112 and fixedly connected with an inner wall of the third connecting hole.

In the present example, the user, after completing the use, moves the second sub-rod 112 out from the second connecting hole and the third connecting hole. Due to the elastic force of the elastic element 32, the first sub-rod 110, the second sub-rod 112 and the third sub-rod 113 can be tightly pressed together, realizing the folding of the U-shape rod 31. With the provision of the elastic element 32, the first sub-rod 110, the second sub-rod 112 and the third sub-rod 113 can be still fixed together after being detached, making it convenient for the user to move and store the U-shape rod 31.

The elastic element 32 can be an elastic rope and so on.

On the basis of the above example, furthermore, the air mattress 2 is fixedly connected with the second supporting rod 22. The principle of the support frame is the same as the above, and unnecessary details will not be given herein.

Finally, it is to be explained that the above-mentioned examples are merely used to illustrate the technical solutions of the present invention, rather than limiting the invention. While the detailed description is made to the present invention with reference to the above-mentioned examples, those ordinarily skilled in the art should understand that the technical solutions recited in the above-mentioned examples can be modified, or equivalent substitutions can be made to some or all of the technical features; and these modifications or substitutions do not make the corresponding technical solutions essentially depart from the spirit and scope of the technical solutions of the examples of the present invention.

INDUSTRIAL APPLICABILITY

The folding bed provided in the examples of the present invention includes the support frame and the air mattress, the air mattress being arranged on the support frame, and the support frame supporting the air mattress. When the user lies on the air mattress, the air mattress touches the back of the human body. Since the air mattress is internally filled with air, the air mattress is relatively soft when supporting the back of the human body, thus the comfort degree of the folding bed is improved.

The invention claimed is:

1. A folding bed, comprising:

a support frame; and an air mattress arranged on the support frame, the support frame supporting the air mattress, wherein the support frame comprises:

a supporting body; and a fixing mechanism comprising an adjusting portion, the adjusting portion comprises:

an adjusting part; and a second fixing structure comprising:

a second fixing protrusion; and a fixing groove, and wherein the second fixing protrusion is arranged on the adjusting part, the fixing groove is arranged on the supporting body, the second fixing protrusion is snapped in the fixing groove to fix the adjusting part with the supporting body, and to enable the adjusting portion to be positioned in a first position, a second position and a third position, respectively, wherein the third position is a position at which the air mattress is unfolded, the supporting body comprises a first sub-rod, a second sub-rod and a third sub-rod, and the adjusting part comprises an adjusting plate and a handle, when the adjusting portion is positioned in the third position, on a plane where the adjusting portion is rotated, a gap is formed between the handle and the first sub-rod or the third sub-rod, and the gap is configured to allow a hand of a user to pass therethrough, so as to hold the handle.

2. The folding bed according to claim 1, wherein the support frame comprises a fixing frame, a movable frame and a first fixing structure;

the fixing frame is rotationally connected with the movable frame; the first fixing structure is arranged on the fixing frame and the movable frame for fixing the movable frame with the fixing frame after the movable frame is rotated relative to the fixing frame by a predetermined angle.

3. The folding bed according to claim 2, wherein the first fixing structure comprises a fixing part provided with a fixing hole and a first fixing protrusion used to be snapped in the fixing hole;

the first fixing protrusion is provided on the movable frame; and the fixing part is provided on the fixing frame.

4. The folding bed according to claim 3, wherein the first fixing structure further comprises a spring;

the movable frame is provided with a groove; the first fixing protrusion has one end arranged in the groove and the other end used to be snapped in the fixing hole; the spring has one end connected with a bottom wall of the groove and the other end connected with the first fixing protrusion.

5. The folding bed according to claim 4, wherein the fixing part comprises a first side wall and a second side wall provided in parallel at an interval; the first fixing protrusion is in number of two; and the movable frame comprises a movable rod;

both the first side wall and the second side wall are provided with a plurality of the fixing holes; the movable rod is rotationally connected with the first side wall and the second side wall via a rotation shaft; all of the plurality of fixing holes on the first side wall and the second side wall are distributed in a circular arc shape with the rotation shaft as a circle center;

the two first fixing protrusions are symmetrically arranged on both sides of the movable rod, and one of the two first fixing protrusions is used to be snapped in the fixing hole on the first side wall, and the other is used to be snapped in the fixing hole on the second side wall.

6. The folding bed according to claim 1, further comprising a supporting bracket;

the supporting bracket being arranged on one side of the support frame away from the air mattress for supporting the support frame.

7. The folding bed according to claim 6, wherein the supporting bracket comprises a connecting rod and two supporting parts;

the two supporting parts are oppositely arranged on two sides of the support frame respectively; and two ends of the connecting rod are connected with one of the supporting parts respectively.

8. The folding bed according to claim 1, wherein the air mattress is detachably connected with the support frame.

9. The folding bed according to claim 8, wherein the air mattress is provided with a hook for hanging on the support frame.

10. The folding bed according to claim 1, wherein the fixing mechanism comprises the adjusting portion and a second supporting rod; the second supporting rod is used to fix the air mattress;

the adjusting portion is arranged on the supporting body; the second supporting rod is fixed on the adjusting portion; and the adjusting portion is used to adjust a position of the second supporting rod and unfold the air mattress.

11. The folding bed according to claim 10, wherein the adjusting part is rotationally connected with the supporting body; the second supporting rod is fixedly connected with the adjusting part, and the second fixing structure is able to have the adjusting part fixed with the supporting body after the adjusting part unfolds the air mattress.

12. The folding bed according to claim 11, wherein the adjusting part comprises an adjusting plate; and the adjusting plate is provided with an arc-shaped slot for the second supporting rod to snap in.

13. The folding bed according to claim 12, wherein the adjusting part comprises a handle; and the handle is fixedly connected with the adjusting plate.

14. The folding bed according to claim 10, wherein the fixing mechanism is in number of two; the two fixing mechanisms are arranged at an interval on the supporting body; and the two supporting rods are used to be fixedly connected with two opposite ends of the air mattress respectively.

15. The folding bed according to claim 10, wherein the supporting body comprises a U-shape rod; and the adjusting portion is connected with an upper end of the U-shape rod.

16. The folding bed according to claim 15, wherein the first sub-rod, the second sub-rod and the third sub-rod are detachably fixed and connected in sequence so as to form the U-shape rod; and the adjusting portion is arranged on an upper end of the first sub-rod.

17. The folding bed according to claim 16, wherein the supporting body comprises a third connector, a fourth connector and an elastic element;

the third connector is provided with a first connecting hole and a second connecting hole; the fourth connector is provided with a third connecting hole and a fourth connecting hole; a lower end of the first sub-rod is inserted in the first connecting hole; both ends of the second sub-rod are inserted in the second connecting hole and the third connecting hole respectively; a lower end of the third sub-rod is inserted in the fourth connecting hole; and the elastic element has one end fixedly connected with an inner wall of the second connecting hole and the other end passing through the second sub-rod and fixedly connected with an inner wall of the third connecting hole.

18. The folding bed according to claim 1, wherein the air mattress is made from a composite fabric consisting of TPU, PVC or EVA.

* * * * *